United States Patent [19]

Hockey et al.

[11] 4,379,059

[45] Apr. 5, 1983

[54] FABRIC SOFTENING COMPOSITION AND A PROCESS FOR PREPARING IT FROM CATIONIC SURFACTANT AND THICKENER

[75] Inventors: John A. Hockey; Malcolm A. Shaw; John L. Wilby; Allan A. Wilson, all of Wirral, England

[73] Assignee: Lever Brothers Company, New York, N.Y.

[21] Appl. No.: 318,514

[22] Filed: Nov. 5, 1981

[30] Foreign Application Priority Data

Nov. 7, 1980 [GB] United Kingdom ..... 8035862

[51] Int. Cl.[3] ..... C11D 1/62; D06L 1/12

[52] U.S. Cl. ..... 252/8.8; 8/137; 252/8.6

[58] Field of Search ..... 252/8.6, 8.8; 8/137

[56] References Cited

U.S. PATENT DOCUMENTS

| | | | |
|---|---|---|---|
| 2,663,989 | 12/1953 | Schlatter et al. | 428/264 |
| 2,826,506 | 3/1958 | Trusler | 106/208 |
| 2,994,665 | 8/1961 | Reich et al. | 252/137 |
| 3,435,027 | 3/1969 | Des Marais et al. | 536/66 |
| 3,523,088 | 8/1970 | Dean et al. | 252/138 |
| 3,668,000 | 6/1972 | Forschirm et al. | 427/445 |
| 3,712,873 | 1/1973 | Zenk | 252/8.9 |
| 3,920,561 | 11/1975 | Des Marais | 252/8.8 |
| 3,928,213 | 12/1975 | Temple et al. | 252/8.8 |
| 4,165,290 | 8/1979 | Johnson et al. | 252/8.8 |
| 4,237,016 | 12/1980 | Rudkin et al. | 252/8.8 |
| 4,326,965 | 4/1982 | Lips et al. | 252/8.8 |

FOREIGN PATENT DOCUMENTS

| | | |
|---|---|---|
| 1190 | 3/1979 | European Pat. Off. . |
| 1073462 | 6/1967 | United Kingdom . |
| 2039556 | 8/1980 | United Kingdom . |
| 1576325 | 10/1980 | United Kingdom . |

*Primary Examiner*—A. Lionel Clingman

*Attorney, Agent, or Firm*—Milton L. Honig; James J. Farrell

[57] ABSTRACT

A rinse conditioner containing cationic surfactant and optionally other surfactants or fatty materials is prepared to relatively high viscosity at which it is stable. The process step necessary to achieve this is first to prepare a relatively mobile dispersion of the active materials and to thicken this mobile dispersion with a nonionic or weakly anionic thickener. Examples of such thickeners are guar gum, polyvinylacetate and polyacrylamide.

5 Claims, No Drawings

FABRIC SOFTENING COMPOSITION AND A PROCESS FOR PREPARING IT FROM CATIONIC SURFACTANT AND THICKENER

This invention relates to a fabric softening composition and to a process for preparing it.

Fabric softening compositions are used in textile finishing and laundering processes to impart properties such as softness and a pleasant feel or "handle" to fabrics, and are used particularly in a final stage of the laundering process immediately after the laundry articles have been washed in a washing machine.

A large number of proposals have been made for the formulation of fabric softening compositions, most of these involving the use of an aqueous dispersion of a cationic surfactant, for instance a quaternary ammonium salt, a pyridnium salt or an imidazolinium salt, as the active component or as part of it. It has been suggested that nonionic and anionic surfactants could be used as another part of the active component, and of these we believe that glycerol monostearate and certain alkyl ether sulphates have been used. We have also proposed in British patent application No. 2039556 that fabric softening compositions should be formulated to comprise a dispersion of cationic surfactant together with free fatty acid.

All of the above compositions based on dispersions of cationic surfactants are non-Newtonian in character. Consequently, they respond unpredictably to shear forces encountered during handling, for example pumping and packing, in the factory. The consequence for the manufacturer is that the final viscosity/pourability characteristics are unpredictable, which creates a problem since in compositions intended for use by housewives in the home the viscosity (or strictly the apparent viscosity) of the composition is an important factor in its acceptability to the consumer, the more viscous compositions being perceived as being of higher quality than the more mobile ones. Manufacturers therefore attempt to produce a product which is as viscous as possible without being so viscous that problems are created elsewhere, such as in pouring or dispensing characteristics. In compositions intended for automated dispensing in washing machines, a low but tightly controlled viscosity is desirable, which again is difficult to achieve if the composition behaves unpredictably in the factory.

We have now discovered how to manufacture a fabric softening composition comprising an aqueous dispersion of a cationic surfactant so that we obtain good control of the final viscosity of the composition.

Accordingly, in its broadest aspect the present invention provides a process for the manufacture of a fabric softening composition having a defined final viscosity which comprises, sequentially or simultaneously, (i) forming an aqueous dispersion comprising a cationic surfactant having a viscosity less than the final viscosity; and (ii) thickening the composition to the final viscosity with a nonionic or weakly anionic polymeric thickener.

Where the process steps of forming the dispersion and of thickening it are performed simultaneously, it may be difficult to determine, in some instances, whether the viscosity of the dispersion is less than the final viscosity, as is required in the process of the invention. However, this will become apparent if the process is repeated, except that the polymeric thickener is omitted from the mix.

The final viscosity of the composition will be chosen in accordance with the end use desired, compositions designed for use by housewives in the home being of a viscosity of around 70–80 cps at 25° C. and 110 $secs^{-1}$.

It will be appreciated that the essence of the process of this invention is to form a dispersion less viscous than is in fact desired and to thicken it with a selected polymeric thickener. One of the ways of obtaining a dispersion of low viscosity is to shear-thin the composition, for example by rapid mixing or stirring. Another way is to heat the dispersion to a temperature above a critical temperature characteristic of the composition. We prefer that our compositions are prepared by the latter method.

The term "nonionic or weakly anionic polymeric thickener" is used herein to denote polymeric thickeners which are not substantially ionically charged. Thus, the numerous quaternised gums and anionic polyelectrolytes are not appropriate here. Examples of thickeners which are suitable, on the other hand, are cellulosic polymers such as hydroxethyl or hydroxypropyl cellulose, alkylated cellulose such as methyl, ethyl, propyl or butyl cellulose or mixed alkylated cellulose, unmodified guar gum, hydroxyethyl- and hydroxypropyl- substituted guar gums, mixtures of guar gum and xanthan gum containing less than 10% of the latter, the less anionic polyacrylamides and polyvinylacetate. For reasons of cost effectiveness the guar gum based polymers and polyvinylacetate are preferred.

Guar gum is the principal component of the seed of the guar plant. Chemically, it is a galactomannan; that is to say it is essentially a polymer of mannose, the mannose being linked by beta(1–4)glyoside linkages, every alternative mannose bearing a galactose side chain linked through an alpha(1–6)glycoside linkage. Guar gum and the derivatives mentioned above are obtainable from Hercules Powder Company under the Hercules Guar Gum THI trade mark.

Certain other modified guar gums are also available. Those that have been modified by the introduction of ionisable groups into the molecule, particularly cationic groups, have been found to be unsuitable for use in the process and composition of the invention, because they flocculate the active components of the composition.

Depending upon the viscosity required, the polymeric thickener may be present in the compositions of the invention in an amount of from 0.01 to 0.80%, preferably 0.05 to 0.30% by weight of the composition.

In a second aspect, the invention provides a fabric softening composition comprising an aqueous dispersion of a cationic surfactant characterised by being thickened with a nonionic or weakly anionic polymeric thickener having a viscosity of 70 centipoise or more measured at a temperature of 25° C. and at a shear rate of 110 $secs^{-1}$.

The cationic surfactant (which is relatively waterinsoluble) used in the present invention will essentially contain two aliphatic alkyl or alkenyl chains having from 14–22, preferably 16–18 carbon atoms. These groups will normally be present in a quarternary ammonium chloride or bromide or in a pyridinium or imidazolinium salt. Typical examples of such compounds are di(hardened tallow)dimethyl ammonium chloride, dicocodimethyl ammonium chloride and 2-hepta-decyl-1-methylstearoyl amido ethyl imidazoline methosulphate. Other suitable examples of such cationic surfactants having two long-chain alkyl groups can be readily found in the art, eg in the above-cited patent and in Schwartz-Perry, Vol II, 1958, "Surface Active Agents and Detergents". Mixtures of two or more of these cationics may also be used.

In addition to the cationic surfactant, the aqueous dispersion may contain anionic surfactants and/or fatty materials. Examples of these are $C_{10}$–$C_{24}$ alkyl ether sulphates, glycerolmonostearate and free fatty acids, of which the latter are preferred.

The fatty acids which may be used in the present invention will normally be $C_8$–$C_{24}$ alkyl- or alkenymonocarboxylic acids, or polymers thereof. Preferably, the saturated fatty acids are used because of their lower odour, and of these the hardened tallow $C_{16}$–$C_{18}$ fatty acids are preferred. Mixtures of various fatty acids may also be used.

The amount of cationic detergent surfactant in the composition varies from 50–95 mole %, preferably 50–80 mole %, and the amount of fatty acids varies from 5–50, preferably 10–40 mole %.

The total weight of cationic detergent surfactant plus anionic surfactant and/or fatty acid or other fatty material may be from 2–20% by weight of the total composition.

The compositions of the invention may furthermore comprise the normal adjuvants, usually present in such compositions. Examples thereof are inorganic salts in minor amounts, such as sodium chloride, solvents such as ethyl- or isopropyalcohol or hexyleneglycol (up to 15%), nonionic surfactants such as condensates or ethylene oxide and/or propylene oxide with fatty alcohols or fatty acids, esters of fatty acids with polyols, eg glycerolmonostearate, ethoxylated sorbitan esters in minor amounts (up to 5%), emulsifiers, pearlescers, perfumes, colourants, germicides, and hydrotropes. Clays, such as smectitetype clays, should not be included in any significant amount, as they may cause unstable products. The pH of the composition is 5 or below, or adjusted thereto.

The process of the invention can be carried out in any suitable manner. However, it is preferred that the aqueous dispersion is formed by melting the cationic surfactant, or co-melting it with any anionic surfactant, fatty acid or other fatty material which may be required, adding the polymeric thickener to the melt and dispersing the components in water having a temperature above the melting range of the melt. The dispersion can be formed by mixing the components in a suitable mixer such as a paddle stirrer. The temperature of the total composition should remain above the melting point of the composition until a uniform dispersion is obtained. Desirably, the dispersion is formed to a viscosity of 30–50 cps measured at 25° C. and 110 $secs^{-1}$ shear rate using a Ferranti Cup and Bob Viscometer. When formulating a composition for use in the home, this dispersion will normally be thickened with the polymeric thickener free from ionisable groups to a viscosity of 70–80 cps. The invention will further be illustrated by the following Examples.

EXAMPLE 1

6.0 parts of a 3:1 weight for weight mixture of a di-hardened tallow dimethyl quaternary ammonium chloride sold under the Registered Trade Mark Arquad 2HT by AKZO Chemie, and a mixture of $C_{16}$–$C_{24}$ saturated and unsaturated fatty acids sold under the Registered Trade Mark Pristerine 4910 by Price's Chemicals Limited, Bromborough, together with a colourant was heated until molten and was then poured into 100 parts of water at a temperature of about 70° C. in a mixer, during which process simultaneous dispersion and thinning took place. Perfume and varying amounts of guar gum as shown in the table were then mixed into the composition. The viscosity was measured using a Ferranti Cup and Bob Viscometer at 25° C. and at 110 $secs^{-1}$ shear rate.

The composition was stored at 20° C. for a number of weeks, the viscosity being re-measured at fixed intervals as shown in Table 1.

TABLE 1

| Viscosity (cps) of product containing guar gum after storage | | | | |
|---|---|---|---|---|
| Guar Gum | Time (weeks): | | | |
| Conc (%) | 0 | 3 | 6 | 10 |
| 0.00 | 37.9 | 43.4 | 43.4 | 45.0 |
| 0.10 | 75.8 | 85.3 | 81.4 | 83.7 |
| 0.15 | 91.6 | 102.3 | 94.6 | 99.2 |
| 0.20 | 98.0 | 108.5 | 102.3 | 105.4 |
| 0.25 | 129.6 | 141.1 | 108.5 | 138.0 |
| 0.30 | 158 | 155 | 155 | 155 |

It can be seen from the table that a fabric softening composition containing a di-hardened tallow dimethyl quaternary ammonium salt and a mixture of fatty acids can be thickened to a satisfactory viscosity using guar gum, and that the viscosity achieved remains relatively constant.

No physical stability problems were encountered during this experiment.

EXAMPLE 2

Four sets of pairs of aqueous dispersions containing 5.0% or 6.0% w/v of the mixture described in Example 1 were prepared. One of the pair was unthickened and the other was thickened with either 0.15% or 0.08% of guar gum. The formulation details are shown in the table. The processing conditions, including the degrees of shear applied were varied so that the compositions had varying final viscosities. Each composition was then stored for 12 weeks at 20° C. and the viscosities were redetermined at intervals. The results are shown in Table 2.

TABLE 2

| Conc of Active Mixture | Conc of Guar Gum | Initial Vis- | Viscosity after storage Weeks | | | | | | | |
|---|---|---|---|---|---|---|---|---|---|---|
| (% w/v) | (% w/v) | cosity | 1 | 2 | 3 | 4 | 6 | 8 | 10 | 12 |
| 6.0 | Nil | 47 | 73 | | | 130 | | | | |
| | 0.80 | 46 | | 55 | 54 | | 51 | | 54 | |
| 6.0 | Nil | 71 | | | | 92 | | 96 | | 91 |
| | 0.08 | 76 | | 89 | 85 | | 81 | | 84 | |
| 6.0 | Nil | 102 | 137 | | | | | 158 | | 158 |
| | 0.08 | 98 | | 115 | 108 | | 102 | | 105 | |
| 5.0 | Nil | 35 | 74 | | | | | 68 | | 87 |

TABLE 2-continued

| Conc of Active Mixture (% w/v) | Conc of Guar Gum (% w/v) | Initial Viscosity | Viscosity after storage Weeks 1 | 2 | 3 | 4 | 6 | 8 | 10 | 12 |
|---|---|---|---|---|---|---|---|---|---|---|
| | 0.15 | 40 | | | 41 | | 37 | | 39 | |

As can be seen from the Table, in the processes and formulations in which guar gum is absent there is a considerable increase in the viscosity of the compositions on storage, regardless of the initial viscosity, whereas the compositions containing guar gum show considerably less increase in viscosity. Consequently, it can be seen that the use of guar gum in the processes and compositions of the invention affords superior control over the final viscosity of the compositions.

EXAMPLE 3

In a model experiment, a 2% aqueous dispersion of di-(hardened tallow)-dimethyl ammonium chloride (Arquad 2HT, Registered Trade Mark) was thickened with guar gum and with a quaternised guar gum (Jaguar C-13S, Registered Trade Mark).

The initial viscosity of each product was measured as described in Example 1 and then the products were stored at 37° C. The results are shown in Table 3.

TABLE 3

| Viscosity and behaviour on storage of thickened solutions | | | |
|---|---|---|---|
| Thickener | Conc (%) | Viscosity | Comments |
| Quaternised Guar Gum | 0.2 | 47 | Separated after |
| | 0.3 | 76 | four weeks |
| Guar Gum | 0.2 | 45 | Stable after |
| | 0.3 | 80 | six weeks |

It can be seen that while both substances produced a dispersion of suitable viscosity, only guar gum produced a product which was stable.

EXAMPLE 4

The extent of the separation produced by the quaternised guar gum can be judged from the following test.

Three compositions prepared as in Example 1 were thickened with a quarternised guar gum and were left to stand at ambient temperatures in transparent cylindrical containers of height 160 mm. After five months, a clear layer had separated from each composition, as shown in Table 4.

TABLE 4

| Conc of quarternised guar gum (%) | Height of separated layer (mm) |
|---|---|
| 0.10 | 23 |
| 0.15 | 18 |
| 0.20 | 11 |

This experiment demonstrates that a cationic guar gum derivative is not suitable for use in the process and compositions of the invention.

EXAMPLE 5

The procedure of Example 1 was followed except that guar gum was replaced by one of the polymers shown in Table 5 in an amount sufficient to provide a concentration of 0.2% in the final composition. Each composition prepared was subjected to storage testing. The final viscosity and the period of storage is shown in the table.

TABLE 5

| Polymer | Viscosity (cps) | Storage (weeks) |
|---|---|---|
| Hydroxyethyl/propyl - substituted guar gum | 124 | 16 |
| Ethyl cellulose (Natrosol* 75) | 91 | 4 |
| Guar gum/xanthan gum blend[A] | 73.5 | 12 |
| Polyacrylamide[B] | 178 | 10 |
| Polyvinylacetate[C] | 72 | 16 |

[A]A blend of guar gum 94% and xanthan gum 6%. The xanthan gum was Biozan* R.
[B]The polyacrylamide was Crosfloc* EN10
[C]The polyvinylacetate was Vinapol* 1000
*Registered Trade Marks

We claim:

1. A process for the manufacture of a fabric softening composition having a stable final viscosity, characterized by sequentially or simultaneously,
   (i) forming an aqueous dispersion comprising from about 2% to about 20% by weight of a cationic surfactant, said dispersion having a viscosity of 30–50 cps at 25° C. and 110 $secs^{-1}$ shear rate; and
   (ii) thickening the composition to the final viscosity with from about 0.01% to about 0.8% of a nonionic or weakly anionic polymer selected from the group consisting of polyacrylamide, polyvinylacetate, guar gum and mixtures of guar gum and xanthan gum containing no more than 10% by weight of xanthan gum, said final viscosity being 70 centipoise or more measured at a temperature of 25° C. and at a shear rate of 110 $secs^{-1}$.

2. A process according to claim 1 characterized in that stage (i) of the process is performed by heating the dispersion to a temperature above the melting point of the surfactant and stirring.

3. A process according to claim 1 characterized in that stage (i) of the process is performed by forming the dispersion in a high shear mixer.

4. A fabric softening composition comprising an aqueous dispersion containing from about 2% to about 20% of a cationic surfactant and from about 0.01% to about 0.8% of a nonionic or weakly anionic polymer selected from the group consisting of polyacrylamide, polyvinylacetate, guar gum and mixtures of guar gum and xanthan gum containing no more than 10% by weight of xanthan gum, said aqueous dispersion having a viscosity of 70 centipoise or more measured at a temperature of 25° C. and at a shear rate of 110 $secs^{-1}$.

5. A fabric softening composition according to claim 4 characterized in that the nonionic or weakly anionic polymer is present in an amount of from 0.05 to 0.3% by weight of the composition.

* * * * *